United States Patent [19]

Bozek et al.

[11] Patent Number: 5,001,026

[45] Date of Patent: Mar. 19, 1991

[54] CRT SCREEN EXPOSURE DEVICE AND METHOD

[75] Inventors: William W. Bozek, Waterloo; Richard I. Brown, Seneca Falls; Mark D. Dorogi, Romulus, all of N.Y.

[73] Assignee: North American Philips Corporation, New York, N.Y.

[21] Appl. No.: 308,510

[22] Filed: Feb. 9, 1989

[51] Int. Cl.[5] ..... G03C 5/00

[52] U.S. Cl. ..... 430/23; 430/24; 430/396; 354/1

[58] Field of Search ..... 430/23, 24, 396; 354/1

[56] References Cited

U.S. PATENT DOCUMENTS 4,078,239 3/1978 Prazak et al. ..... 354/1

*Primary Examiner*—Marion E. McCamish
*Assistant Examiner*—J. Weddington
*Attorney, Agent, or Firm*—John C. Fox

[57] ABSTRACT

The need for annealing the internal magnetic shield of a cathode ray tube to eliminate registration errors caused by non-uniformity of magnetic properties of the shield resulting from the forming process, is eliminated by using a shader plate with a convex curvature to adjust the screen pattern to compensate for such errors.

10 Claims, 3 Drawing Sheets

CRT SCREEN EXPOSURE DEVICE AND METHOD

BACKGROUND OF THE INVENTION

This invention relates to an optical device for projecting light onto an aperture mask-panel assembly of a color cathode ray tube (CRT), in order to expose a photosensitive layer on the face of the panel to a pattern corresponding to a desired pattern of luminescent material (phosphor).

In the manufacture of color CRTs for color television, the three-color phosphor screen on the face of the CRT used to display the television image is conventionally formed photolithographically by exposing photosensitive layers on the face to a pattern of light corresponding to the desired pattern of phosphor on the screen.

The finished CRT includes three electron guns in the neck of the tube for directing three electron beams, one for each of the primary colors red, blue and green, to excite the phosphor elements on the screen. An aperture mask positioned a short distance behind the screen has apertures placed to allow the electron beams to impinge only upon the phosphor elements of the corresponding color. A full color display is produced when the three electron beams, each carrying a separate video signal for its primary color, are scanned across the screen. It will be appreciated that in order to achieve the desired color purity, accurate registration between the beams and the corresponding phosphor elements is required.

In order to achieve such accurate registration, the screen is formed by placing a light source at the approximate position of the source of one of the electron beams, and exposing the photosensitive material (resist) through the same aperture mask which will be used in later operation of the tube. Thus, once the screen has been exposed through the mask, the mask is said to be "married" to the panel.

The exposure insolubilizes the resist, after which the unexposed portions are washed away, leaving a first pattern of phosphor elements corresponding to a first primary color. The light source is then moved to correspond to the source of the second electron beam, and the process is repeated to produce a second pattern for the second color, and likewise for the third, resulting in a pattern of alternating red, green and blue phosphor elements in the finished screen.

Because the paths of the light rays during exposure are not identical to the paths of the scanned electron beams during tube operation, a correcting lens is placed between the source and the mask-panel assembly during exposure to achieve a light distribution more nearly like the distribution of the scanned electron beams. In addition, since the insoluble portion of the resist grows larger as the intensity of the exposure increases, a shader plate is also placed in the light path to achieve a desired distribution of light intensity across the face.

Another aspect of achieving accurate registration between the beams and the phosphor elements is the necessity of shielding the beams from external magnetic fields such as the earth's magnetic field during tube operation, which fields could otherwise result in noticeable deflection of the beams from their desired paths.

Such shielding is often accomplished by attaching an internal magnetic shield (IMS) to the mask frame. Such an IMS is typically fabricated from one or more sheets of a soft magnetic material such as steel into a shape which surrounds and extends rearward from the frame along the wall of the tube's envelope.

Since the frame supports the IMS, the IMS need not be self-supporting, and can therefore be relatively easily fabricated from thin gage material. However, such a construction creates handling and assembly problems. A more rugged construction offers the advantage of being readily transportable to an assembly area of the factory floor, where the proper size IMS can be selected and rapidly attached to the mask frame with less risk of damage than for a more fragile IMS.

Unfortunately, the construction of a more rugged IMS requires a heavier gage material and forming operations which work the material sufficiently to locally alter the magnetic properties of the material. Such non-uniformity of magnetic properties must be removed by annealing the IMS in order to prevent non-uniform shielding of the electron beams, which would cause registration errors in the tube. Such annealing adds significantly to the cost of the IMS.

OBJECTS AND SUMMARY OF THE INVENTION

Accordingly, it is an object of the invention to eliminate the need for annealing the IMS of a CRT to remove non-uniformity of magnetic properties such as are caused by forming of the IMS from sheet material.

Other objects of the invention are to provide an optical device and method for exposing the mask-panel assembly of a CRT, which device substantially compensates for registration errors caused by an IMS having non-uniform magnetic properties such as are caused by forming of the IMS from sheet material, without changing the correcting lens.

According to one aspect of the invention, an optical device for exposing the mask-panel assembly of a CRT comprises a light source, a correcting lens and a shader plate to alter the light distribution of the light source, characterized in that the device includes an optical element having one convex surface of uniform curvature, such optical element preferably being the shader plate.

Such curvature is preferably spherical, due to ease of fabrication. Such spherical curvature results in a radially inward movement of the light pattern.

However, the curvature can also be cylindrical, for a CRT in which registration is of concern in one direction only. Such a CRT is the so-called in-line currently used almost universally in color television. The in-line has horizontally aligned electron guns, vertically striped screen and vertically aligned slotted aperture mask. A principal advantage of the in-line is that only registration parallel to the tube's major axis is of concern. The major axis is normal to the vertically oriented screen stripes. In the minor axis direction, i.e., parallel to the stripes, registration is uncontrolled.

According to another aspect of the invention, a method of exposing a mask-panel assembly Y comprises the steps of assembling a light source, correcting lens and shader plate coaxially with the mask-panel assembly, with the lens and plate placed in the light path between the source and assembly, and energizing the source, characterized in that an optical element independent of the main correcting lens and preferably the shader plate, having one convex surface of uniform curvature, is placed in the light path.

In forming the in-line screen with a cylindrically curved optical element, the element is oriented with its cylindrical axis along the tube's minor axis, that is, parallel to the vertical stripes, resulting in the desired inward movement of the light pattern.

DESCRIPTION OF THE PREFERRED EMBODIMENTS

Figure 1:
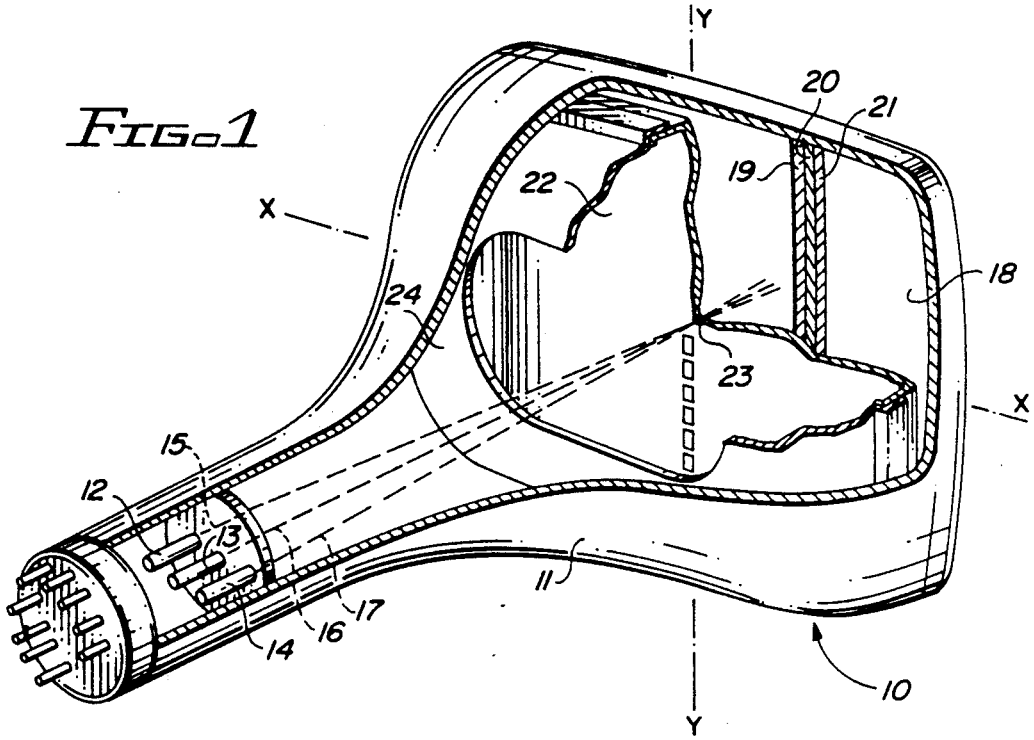
FIG. 1 is a perspective view, partly cut away, of an in-line color CRT with IMS.

Referring now to FIG. 1, color CRT 10 is composed of evacuated glass envelope 11, electron guns 12, 13 and 14, which direct electron beams 15, 16 and 17 toward screen 18, composed of alternating red, blue and green phosphor stripes, three of which, 19, 20 and 21 are shown. The beams 15, 16 and 17 converge as they approach aperture mask 22, then pass through vertical aperture column 23 and diverge slightly to land on the appropriate phosphor stripe 19, 20 or 21. Additional columns of apertures similarly correspond to additional stripe triplets, not shown. External deflection coils and associated circuitry, not shown, cause the beams to scan the mask and screen in a known manner, to produce a rectangular raster pattern on the screen.

Mask 22 and screen 18 are divided into quadrants by horizontal (X) and vertical (Y) axes. IMS 24 shields electron beams 15, 16 and 17 from external magnetic fields such as the earth's magnetic field. IMS 24 is fabricated from a single 6 mil thick sheet of soft magnetic material such as high carbon steel, by deep drawing. While the resulting IMS is sufficiently rugged to withstand transport and handling in a mass production environment, the drawing operation stretches portions of the material sufficiently to locally alter the magnetic shielding properties. If not removed by annealing, these local changes can result in registration errors between the beams and phosphor elements during tube operation.

According to the invention, these registration errors can be substantially eliminated by imparting a convex curvature to one surface of an optical element in the light path between the source and the photosensitive layer, preferably to one side of the shader plate contained in the optical exposure device used to form the screen.

Figure 2:
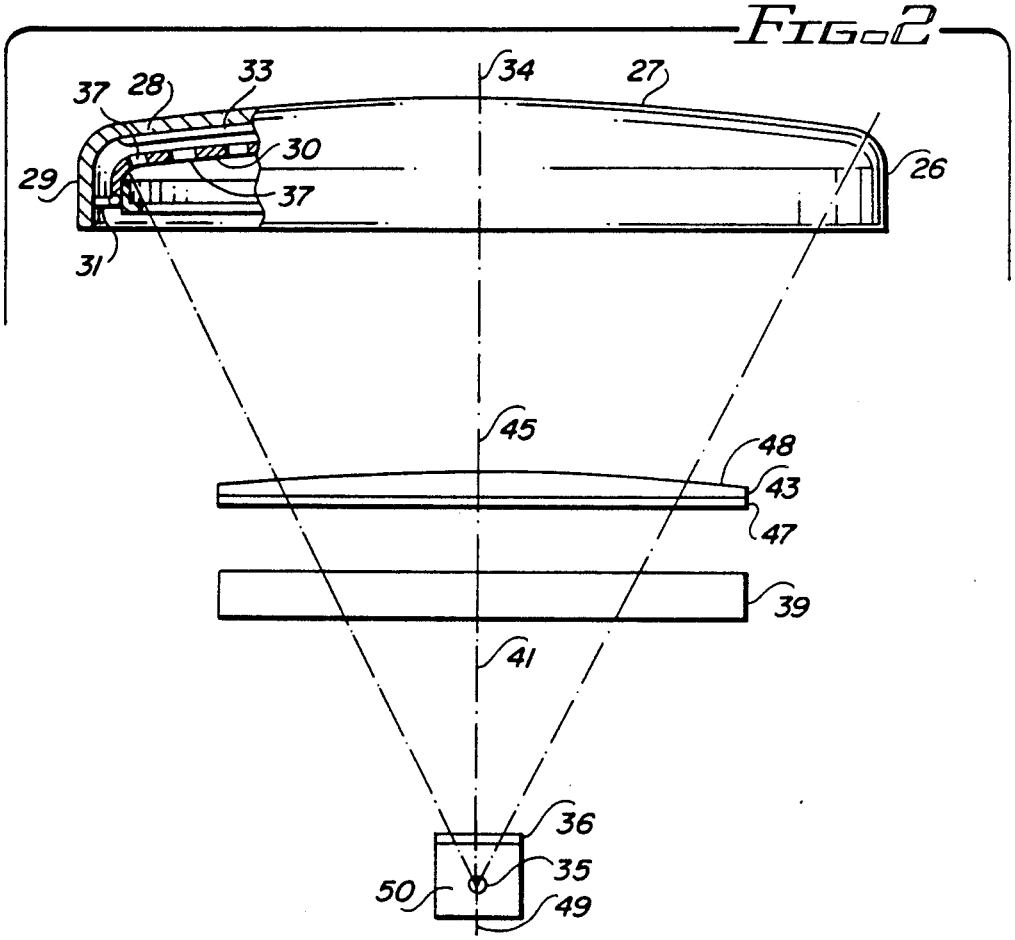
FIG. 2 is a diagrammatic representation of one embodiment of the optical exposure device of the invention.

The preferred embodiment of the exposure device, known as a lighthouse, has the essential optical components shown in FIG. 2. A rectangular panel 26 on which a screen structure is to be printed comprises (a) a face 27 having an inner surface 28 and (b) an integral peripheral sidewall 29. An apertured shadow mask 30 is detachably mounted to the sidewall 29 by a mounting means 31. A coating 33 of dichromate-sensitized polyvinyl alcohol having a nominal coating axis 34 is supported on the inner surface 28 of the face 27.

A point light source 35 is positioned a specified distance P from the mask 30, which itself is spaced a distance Q from the coating 33, as is known in the art. The mask 30 has an array of slits or elongated apertures 37 therethrough, wherein the length direction is substantially parallel to the minor axis Y of the rectangular panel 26 as shown in FIG. 1. The light source 35 is typically a liquid cooled high intensity discharge lamp. A thin quartz plate 36 is placed in front of the light source 35 and houses a cooling liquid 50 around the lamp.

A main light refractor or lens 39 having a nominal lens axis 41 is in a spaced position from the light source 35 in the light path to the coating 33. A light-transmission filter 43 (also called an intensity correction filter or a shader plate) has a nominal filter axis 45 and an optically graded coating 47 on the side towards the light source. The filter 43 is spaced between the lens 39 and the face in the above-mentioned light path. The light source 35 and all of the axes 34, 41 and 45 are aligned along a common axis 49.

According to the invention, the upper surface 48 of the filter or shader plate 43 has a slight convex curvature. By way of example, for an in-line tube having a 27 inch diagonal face and having an IMS of the type described above, and for a shader plate having a diameter of about 10 inches and a spherical contour of surface 48, a radius of curvature of surface 48 within the range of about 750 to 850 inches results in a uniform radially inward displacement of the exposure pattern sufficient to substantially compensate for the registration errors caused by omission of the annealing step in the formation of the IMS.

For the same case as that described above, except that the curvature of surface 48 is cylindrical rather than spherical, a radius of curvature of about 200 to 300 inches is required to achieve approximately the same amount of compensation.

In order to demonstrate the advantages of the invention, two sets of 24 tubes each were made of the 27 inch in-line tube described above. For both sets, the IMS was not annealed after forming. However, for the first set screens were formed using a shader plate having a flat upper surface and for the second set a shader plate with a convex spherical upper surface having a radius of curvature of 800 inches was substituted.

Registration errors parallel to the major or X axis were measured for each tube using a standard testing technique in which an array of 117 points was laid out on the face of the tube, and the registration error for each point was determined by an electronic averaging method in which the voltage needed to move the electron beam to a position of maximum intensity was measured and this voltage related to a distance determined by prior calibration.

Figure 3:
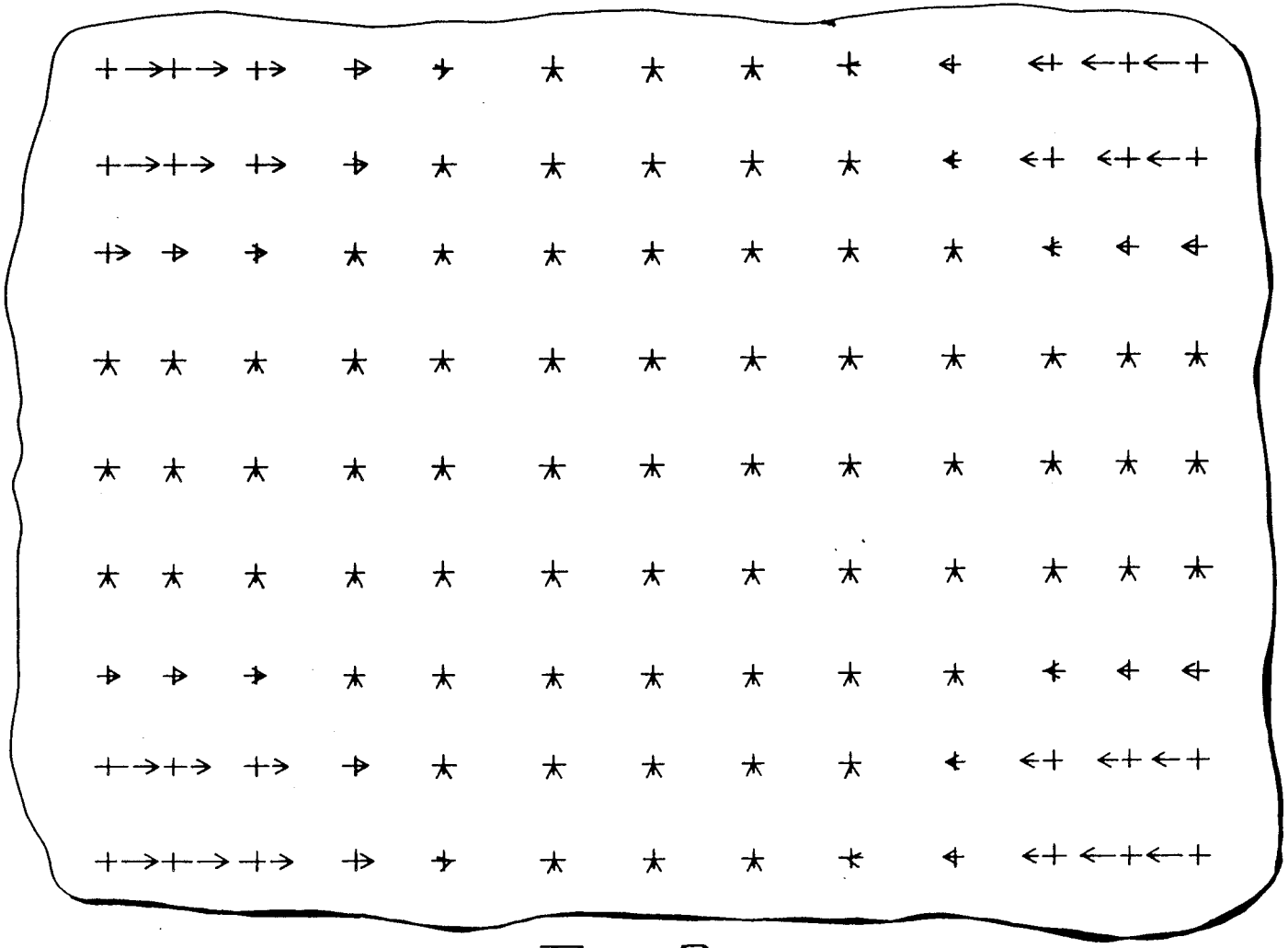
FIG. 3 is a diagrammatic representation of an array of registration error differences measured on an in-line CRT employing a non-annealed IMS of the type shown in FIG. 1.
Figure 4:
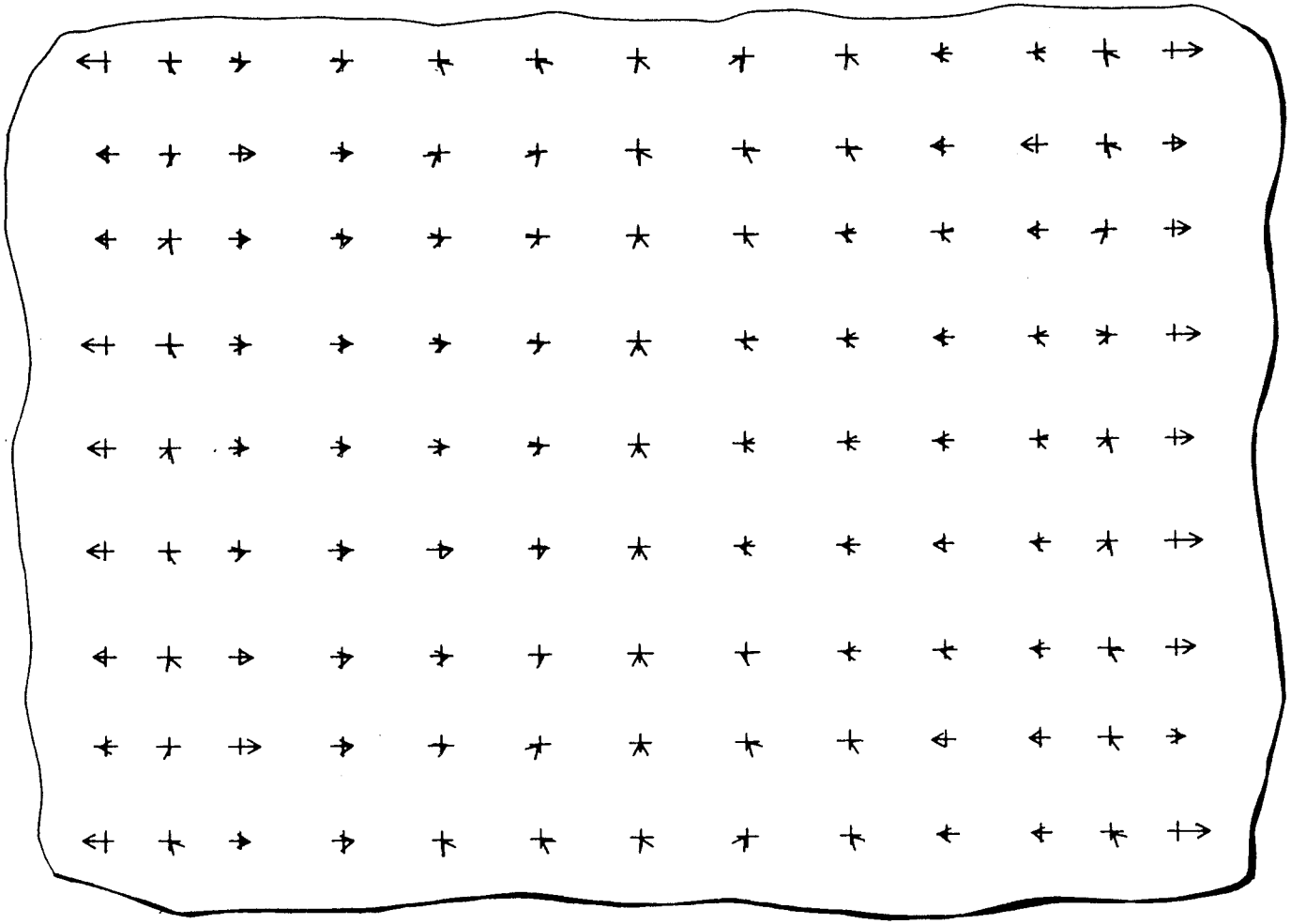
FIG. 4 is a graphical representation similar to that of FIG. 3 in which the error differences have been substantially eliminated by the use of the device of FIG. 2 employing a shader plate with spherical curvature.

Results are presented graphically in FIGS. 3 and 4, in which the average registration error for each point is represented by a vector, the length of which is proportional to the error in the scale of 1 mil to the inch. For the sake of simplicity, the registration errors shown are not the total errors measured, but the difference between the registration errors normally present in such tubes having annealed IMS's and the registration errors measured. Thus, the effect of the curved shader plate can be seen more clearly.

As may be seen from FIG. 3, the errors due to omission of annealing are greatest in the corner regions of the tube, being as much as about 0.7 mils, compared to a phosphor stripe width of about 6 mils. As may be seen from FIG. 4, the errors in FIG. 3 have been substantially reduced or eliminated.

What is claimed is:

1. An optical device for illuminating the mask-panel assembly of a cathode ray tube and exposing a photosensitive layer on the face of the tube to a pattern of light transmitted through the apertures of the mask, the device comprising a light source, a correcting lens and a shader plate, characterized in that the shader plate has one convex surface of uniform spherical curvature, the radius of curvature being within the range of from about 750 to 850 inches.

2. The device of claim 1 in which the curvature is spherical.

3. A method for illuminating the mask-panel assembly of a cathode ray tube and exposing a photosensitive layer on the face of the tube to a pattern of light, the method comprising the steps of arranging a light source, a correcting lens and a shader plate coaxially with the mask-panel assembly, the lens plate placed in the light path between the source and the photosensitive layer, and energizing the light source, characterized in that the shader plate having one convex surface of uniform spherical curvature having the radius of curvature within the range of about 750 to 850 inches is placed in the light path.

4. The method of claim 3 in which the face of the panel of the mask-panel assembly has a 27 inch diagonal.

5. The method of claim 4 in which the apertures of the mask are in the form of slots arranged in vertical columns.

6. An optical device for illuminating the mask-panel assembly of a cathode ray tube and exposing a photosensitive layer on the face of the tube to a pattern of light transmitted through the apertures of the mask, the device comprising a light source, a correcting lens and a shader plate, characterized in that the shader plate has one convex surface of uniform cylindrical curvature.

7. The device of claim 6 in which the radius of curvature is within the range of from about 200 to 300 inches.

8. A method for illuminating the mask-panel assembly of a cathode ray tube and exposing a photosensitive layer on the face of the tube to a pattern of light, the method comprising the steps of arranging a light source, a correcting lens and a shader plate coaxially with the mask-panel assembly, the lens and plate placed in the light path between the source and the photosensitive layer, and energizing the light source, characterized in that the shader plate having one convex surface of uniform cylindrical curvature is placed in the light path.

9. The method of claim 6 in which the apertures of the mask are in the form of slots arranged in vertical columns, and the shader plate is oriented to have the cylindrical axis normal to the vertical columns.

10. The method of claim 8 in which the radius of curvature is within the range of about 200 to 300 inches.

* * * * *